US012662787B2

(12) United States Patent
Akimov et al.

(10) Patent No.: US 12,662,787 B2
(45) Date of Patent: Jun. 23, 2026

(54) OFFSHORE PRODUCTION FACILITY FOR PRODUCING, TREATING AND REFINING RAW GAS

(71) Applicant: Publichnoe Aktsionernoe Obshchestvo "NOVATEK", Tarko-Sale (RU)

(72) Inventors: Dmitriy Vladimirovich Akimov, Moscow (RU); Leonid Viktorovich Mikhelson, Moscow (RU); Sergey Gennadyevich Solovyev, Novyy Urengoy (RU); Oleg Yakovlevich Sochnev, Moscow (RU)

(73) Assignee: Publichnoe Aktsionernone Obshchestvo "NOVATEK", Tarko-Sale (RU)

( * ) Notice: Subject to any disclaimer, the term of this patent is extended or adjusted under 35 U.S.C. 154(b) by 0 days.

(21) Appl. No.: 18/866,213

(22) PCT Filed: Nov. 11, 2022

(86) PCT No.: PCT/RU2022/000334
§ 371 (c)(1),
(2) Date: Nov. 15, 2024

(87) PCT Pub. No.: WO2023/244134
PCT Pub. Date: Dec. 21, 2023

(65) Prior Publication Data

US 2025/0320678 A1 Oct. 16, 2025

(30) Foreign Application Priority Data

Jun. 16, 2022 (RU) ..... 2022116273

(51) Int. Cl.
*E02B 17/02* (2006.01)
*E21B 41/00* (2006.01)

(52) U.S. Cl.
CPC ..... *E02B 17/02* (2013.01); *E21B 41/0007* (2013.01)

(58) Field of Classification Search
CPC ..... E02B 17/02; E21B 41/0007
See application file for complete search history.

(56) References Cited

U.S. PATENT DOCUMENTS 3,412,564 A * 11/1968 Mcclintock ..... E02B 17/02 405/208
3,766,583 A * 10/1973 Phelps ..... F25J 1/0288 405/203

(Continued)

FOREIGN PATENT DOCUMENTS

EP 4 417 754 A1 8/2024
FR 2894646 A1 * 6/2007 ..... F17C 13/082

(Continued)

OTHER PUBLICATIONS

International Search Report in PCT/RU2022/000334, mailed Mar. 16, 2023.

*Primary Examiner* — Matthew R Buck
(74) *Attorney, Agent, or Firm* — Collard & Roe, P.C.

(57) ABSTRACT

An offshore industrial complex for raw gas extraction, treatment, and processing includes a gravity-based structure (GBS) with a topside on it, including a drilling facility with drilling rig, flare unit, process equipment for raw gas treatment and processing as modules, and living quarters. The GBS has central and protruding parts. The central part is a rectangular prism with a top slab, on which the process equipment is installed. The protruding part stretches along the central part sides and has vertical external walls. The central and protruding parts share a base slab, the protruding part being lower in height than the central part. The central part has longitudinal and transverse walls that form compartments, including ballast compartments and compart- (Continued)

Figure 1:
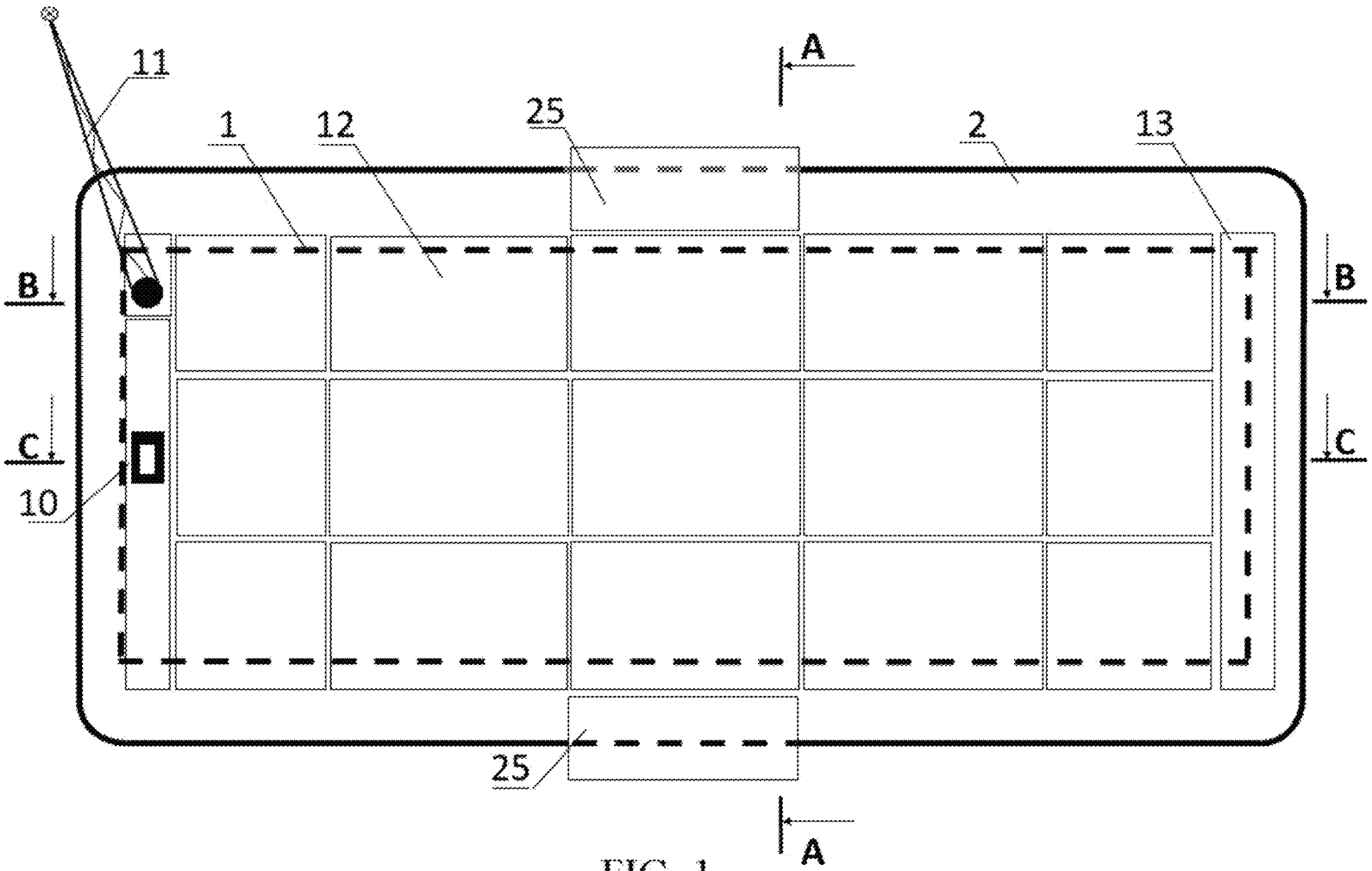

ments accommodating storage tanks for respective processed products. The protruding part has internal walls that are perpendicular to its external walls and form ballast compartments.

6 Claims, 7 Drawing Sheets

(56) References Cited

U.S. PATENT DOCUMENTS

| | | | | |
|---|---|---|---|---|
| 3,863,457 | A * | 2/1975 | Hafskjold | E02D 27/52 405/208 |
| 3,886,753 | A * | 6/1975 | Birdy | E02B 17/025 405/207 |
| 4,285,614 | A * | 8/1981 | Lamy | E02B 17/02 405/203 |
| 4,497,594 | A * | 2/1985 | Fern | E02B 17/02 405/203 |
| 8,641,327 | B2 | 2/2014 | Krehbiel et al. | |
| 10,590,618 | B2 | 3/2020 | Kjersem et al. | |
| 2004/0115006 | A1 * | 6/2004 | Facey | B63B 83/20 405/203 |
| 2021/0122446 | A1 | 4/2021 | Wu | |
| 2022/0324541 | A1 | 10/2022 | Kanayama et al. | |

FOREIGN PATENT DOCUMENTS

| | | | |
|---|---|---|---|
| KR | 10-2017-0049075 | A | 5/2017 |
| KR | 10-1778381 | B1 | 9/2017 |
| RU | 2 488 659 | C2 | 7/2013 |
| RU | 2 719 516 | C1 | 4/2020 |
| RU | 2 762 588 | C1 | 12/2021 |
| WO | 2020/029704 | A1 | 2/2020 |
| WO | 2021/106151 | A1 | 6/2021 |

* cited by examiner

OFFSHORE PRODUCTION FACILITY FOR PRODUCING, TREATING AND REFINING RAW GAS

CROSS REFERENCE TO RELATED APPLICATIONS

This application is the National Stage of PCT/RU2022/000334 filed on Nov. 11, 2022, which claims priority under 35 U.S.C. § 119 of Russian Application No. 2022116273 filed on Jun. 16, 2022, the disclosure of which is incorporated by reference. The international application under PCT article 21(2) was not published in English.

FIELD OF ART

The invention pertains to offshore production facilities and may be used in creation of offshore production complexes to extract, treat, and process hydrocarbon feedstock to produce liquefied natural gas (LNG), wide fraction of light hydrocarbons (WFLH) and stable gas condensate (SGC) on a gravity-based structure (GBS), representing a new type of offshore oil-and-gas structures—GDCPSO (gravity drilling chemical production storage and offloading).

BACKGROUND ART

FPSO (floating production storage and offloading) systems are one of the most widespread technical solutions for offshore hydrocarbons processing.

In particular, FLNG (floating liquefied natural gas) systems are used for offshore LNG plants. In this case, the LNG plant is part of a floating installation that produces, treats, and liquefies natural gas, as well as stores and offloads LNG. FLNGs are used in development of offshore natural gas field and are installed directly at the field using anchoring and/or mooring.

This design features the following disadvantage.

FLNGs are not used in water areas with heavy ice conditions due to impossibility of ensuring reliable positioning required to connect an installation hull to a underwater extraction system when ice moves. Therefore, their use is limited to development of offshore fields in ice-free seas.

There exists an integrated production complex for processing of raw gas on a gravity-based structure (GBS) (RU 2762588 C1, publication date: 21 Dec. 2021) intended for work in near-shore area and containing a GBS that accommodates topside modules containing process equipment. Design of the GBS is adapted for use in water areas with heavy ice conditions.

This complex features the following disadvantages.

1. The complex requires connection to field hydrocarbons extraction and treatment infrastructure.
2. The complex allows for hydrocarbons offloading only from one side of the GBS which faces the sea.
3. The GBS has a large number of compartments with significant total volume which are only used as ballast compartments. These compartments do not have any other functions.

The closest to the proposed offshore complex is the technical solution (KR20170049075 A, publication date: Oct. 5, 2017), in accordance with which a floating installation for natural gas extraction, treatment, liquefaction, and LNG storage and offloading comprises a drilling facility and is a floating drilling LNG production, storage and offloading unit (FDLPSOU). The installation comprises a floating foundation (vessel), a drilling rig placed on it for oil gas production, a flare unit, process equipment comprising gas treatment (purification and dehydration) installations, fractionation installations, and gas liquefaction installations, an unloading appliance, a power plant, accommodations and control rooms, as well as tanks for liquefied natural gas (LNG), liquefied petroleum gas (LPG), and stable gas condensate (SGC) placed within the hull of the vessel, and a mooring turret.

The FDLPSOU is used to develop offshore natural gas fields and is placed directly at the field with the use of dynamic positioning system, and connected to an underwater gas extraction system with the help of the turret.

This design features the following disadvantages.

1. In case of simultaneous drilling of production wells and production of hydrocarbons it is difficult for the FDLPSOU unit to ensure the positioning required for drilling when the production turret is connected.
2. Both the FDLPSOU and the FLNG are not used in water areas with heavy ice conditions due to impossibility of ensuring reliable positioning.

SUMMARY OF THE INVENTION

The technical problem resolved with the invention is as follows. In view of the increasing hydrocarbon production from Arctic offshore fields, there is a pressing need to develop a new efficient production complex for hydrocarbon extracting and processing adapted to operate in waters with ice conditions in the Arctic.

The proposed solution for the above problem is an offshore production complex for raw gas extracting, treating and processing (the "GDCPSO", gravity drilling chemical production storage and offloading) comprising a substructure with a topside on top, including drilling facility, a flare unit, process equipment for raw gas treating and processing, and living quarters, with the foundation accommodating storage tanks for respective processed products. In accordance with the invention, the substructure is a gravity-based structure (GBS) that has a central part and a protruding part, with the central part being a rectangular prism with a top slab housing the process equipment, and the GBS protruding part stretching all along sides of the central part all around its perimeter and having vertical external walls, the central part and the protruding part sharing a base slab, the protruding part being lower in height than the central part, the GBS central part having longitudinal and transverse walls that form compartments, including ballast compartments and compartments accommodating storage tanks for respective processed products, and the GBS protruding part having internal walls that are perpendicular to its external walls and form ballast compartments.

The preferable design of the drilling facility includes a drilling rig installed on a short end of the GBS central part with its compartments under the drilling rig serving as borehole wells.

The preferable design also features compartments of the GBS central part formed by its short-end walls on one side, that include at least one consumables compartment, at least one chemicals compartment, and at least one waste compartment.

Furthermore, some of the compartments in the GBS central part, including at least one of the compartments that is formed by its short-end walls on one side, can be auxiliary compartments.

Furthermore, the GBS central part also has an intermediate horizontal slab accommodating storage tanks for one of the processed products, which is liquefied natural gas, and there are longitudinal and transverse walls forming additional ballast compartments between the intermediate horizontal slab and the base slab.

Furthermore, some of the compartments in the GBS central part form storage tanks for other processed products, which are stable gas condensate and natural gas liquids.

The purpose of the GDCPSO is hydrocarbon production, treatment and processing to produce LNG, WFLH, and SGC.

The GDCPSO is used in offshore field development and is installed at sea directly at the field without any anchoring, mooring or any other system. The GDCPSO is fixed in position after settlement on an underbase foundation 9 by filling the ballast system.

The GDCPSO is used for drilling of production wells and formation fluid treatment for further processing.

The technical result achieved by the proposed technical solution is as follows.

The GBS protruding part adds to buoyancy of GDCPSO and reduces its submersion during transportation to the installation site.

Increased width of the GBS bottom part adds to the stability of the entire structure during its transportation, enabling to install a topside structure of greater height and weight onto the GBS. Seawater is used as ballast during the transportation stage.

Ballast compartments in the peripheral part of GBS inside the protruding part make it easy to balance GBS, i.e. to settle GBS down evenly, without trim and list. Some compartments that perform the function of ballast tanks during the transportation, are used as compartments for the storage of consumables, chemical agents, waste, as utility compartments, and borehole wells during operation after the GBS is installed at the field.

Seawater and firm ballast may be used to fill the ballast compartments to fix the GDCPSO in place.

The protruding part also protects the GBS central part from drifting ice and emergency ship impact.

The protruding part also serves as a foundation for raw gas processing products (LNG, WFLH, and SGC) offloading jetties.

LIST OF DRAWINGS

FIG. 1 shows a layout of the proposed offshore complex from the top.

Figure 2:
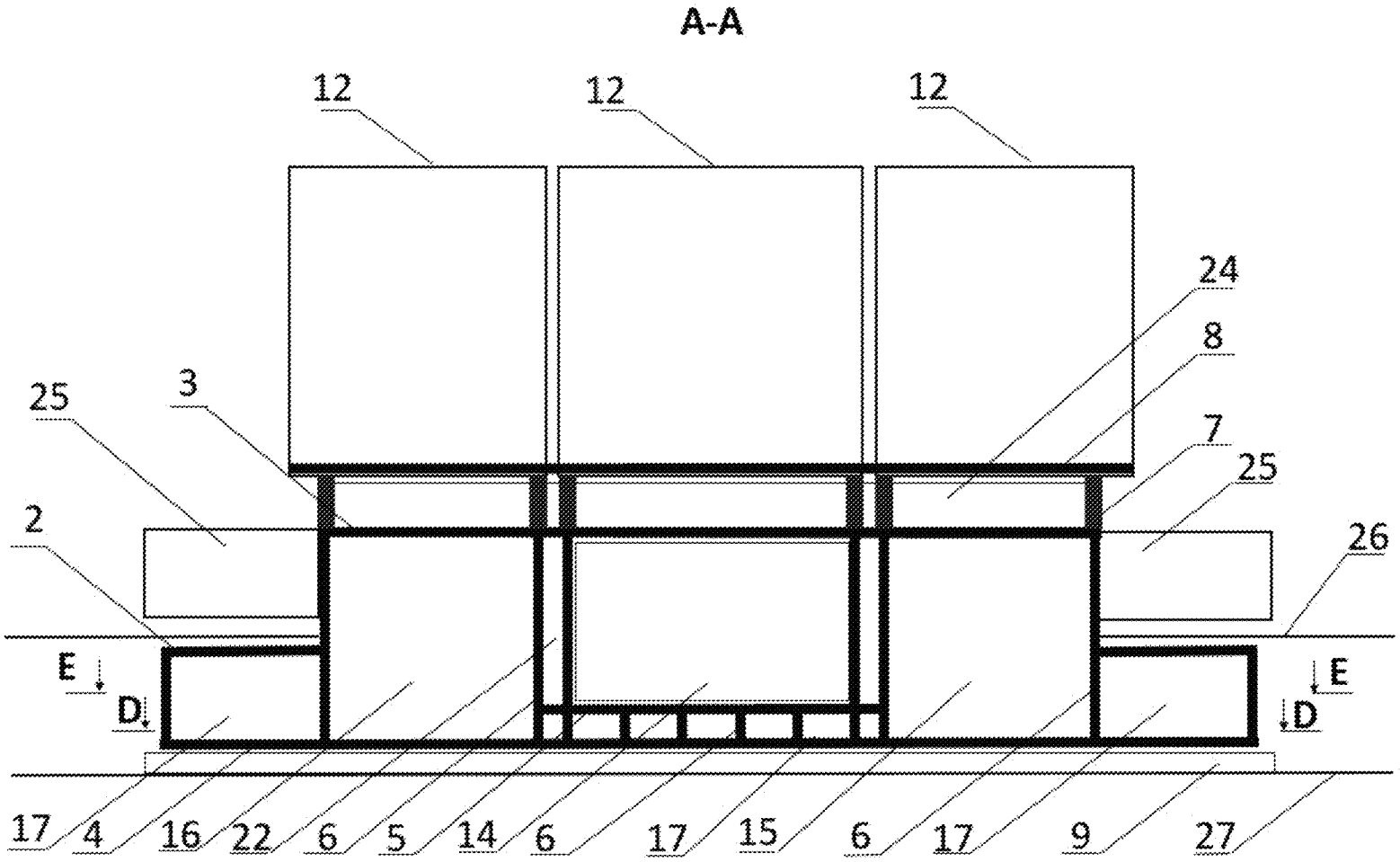

FIG. 2—transverse section A-A for FIG. 1.

Figure 3:
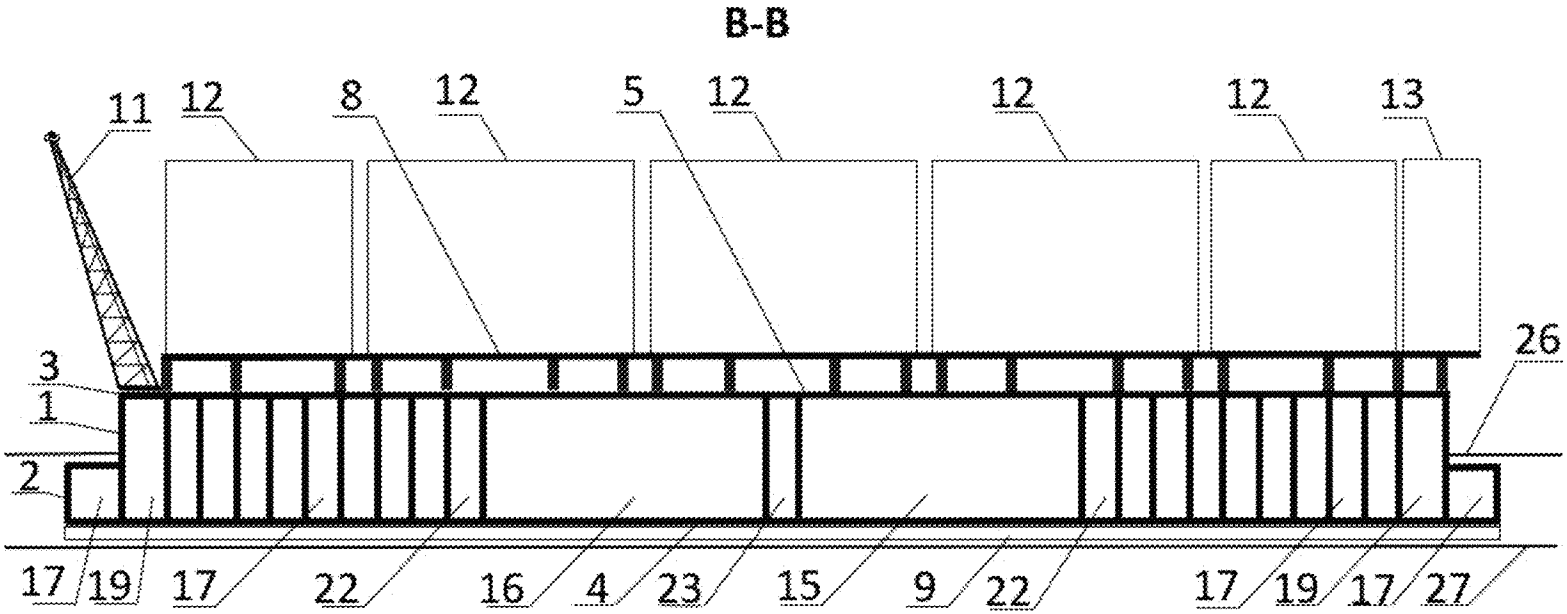

FIG. 3—longitudinal section B-B for FIG. 1.

Figure 4:
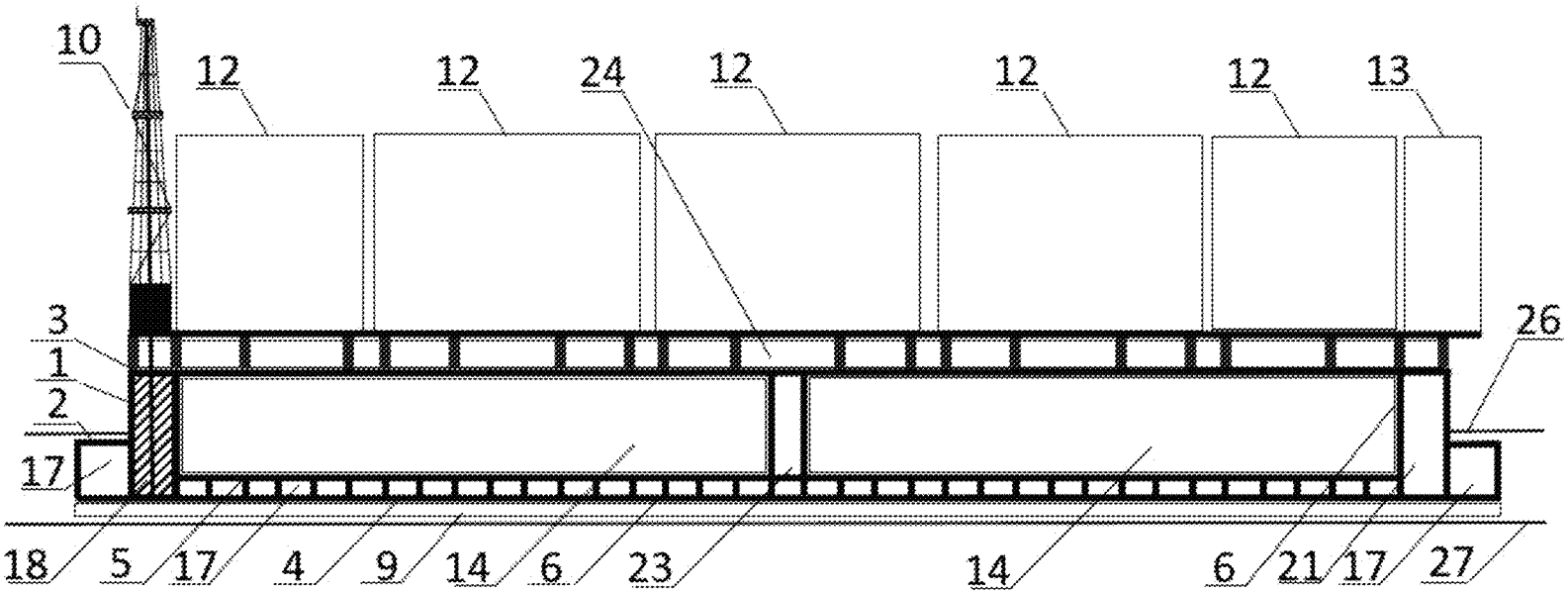

FIG. 4—longitudinal section C-C for FIG. 1.

Figure 5:
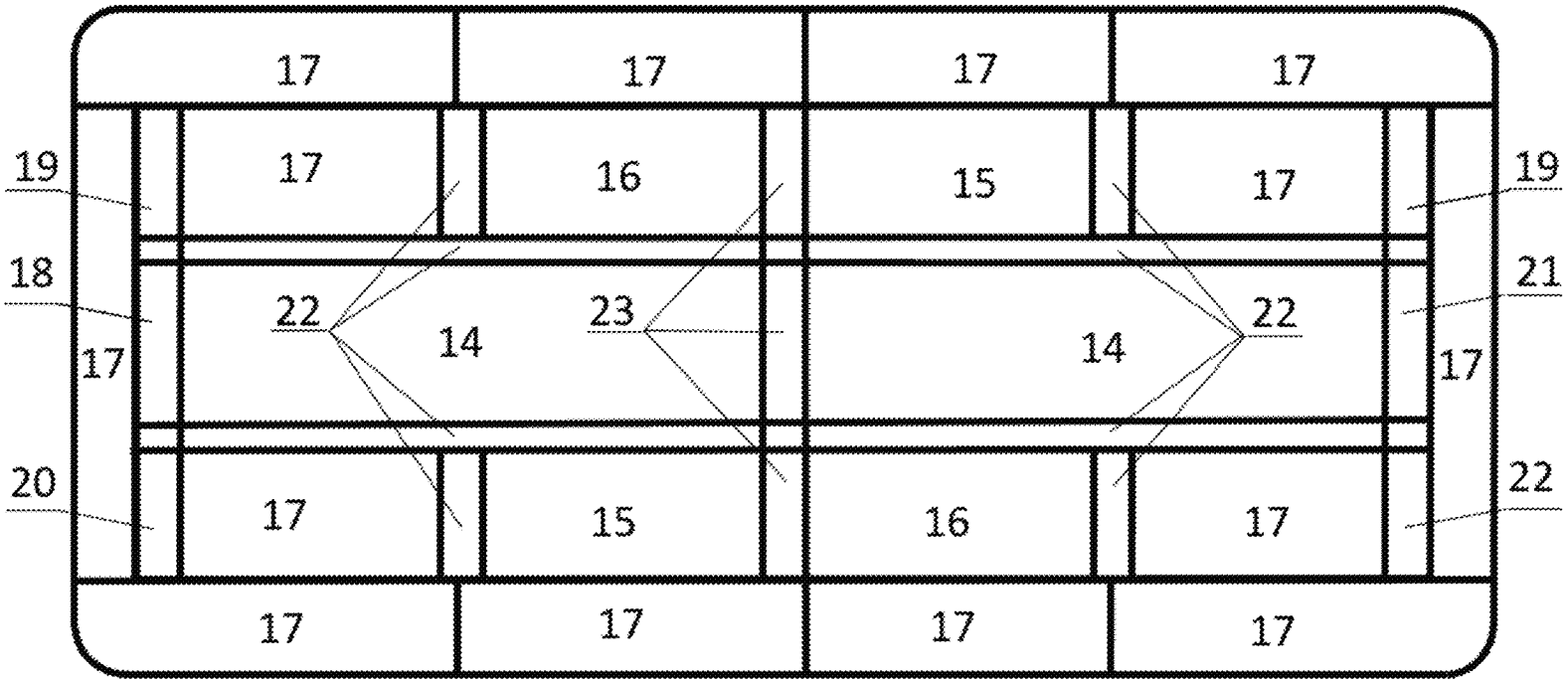

FIG. 5—layout of the GBS main compartments.

Figure 6:
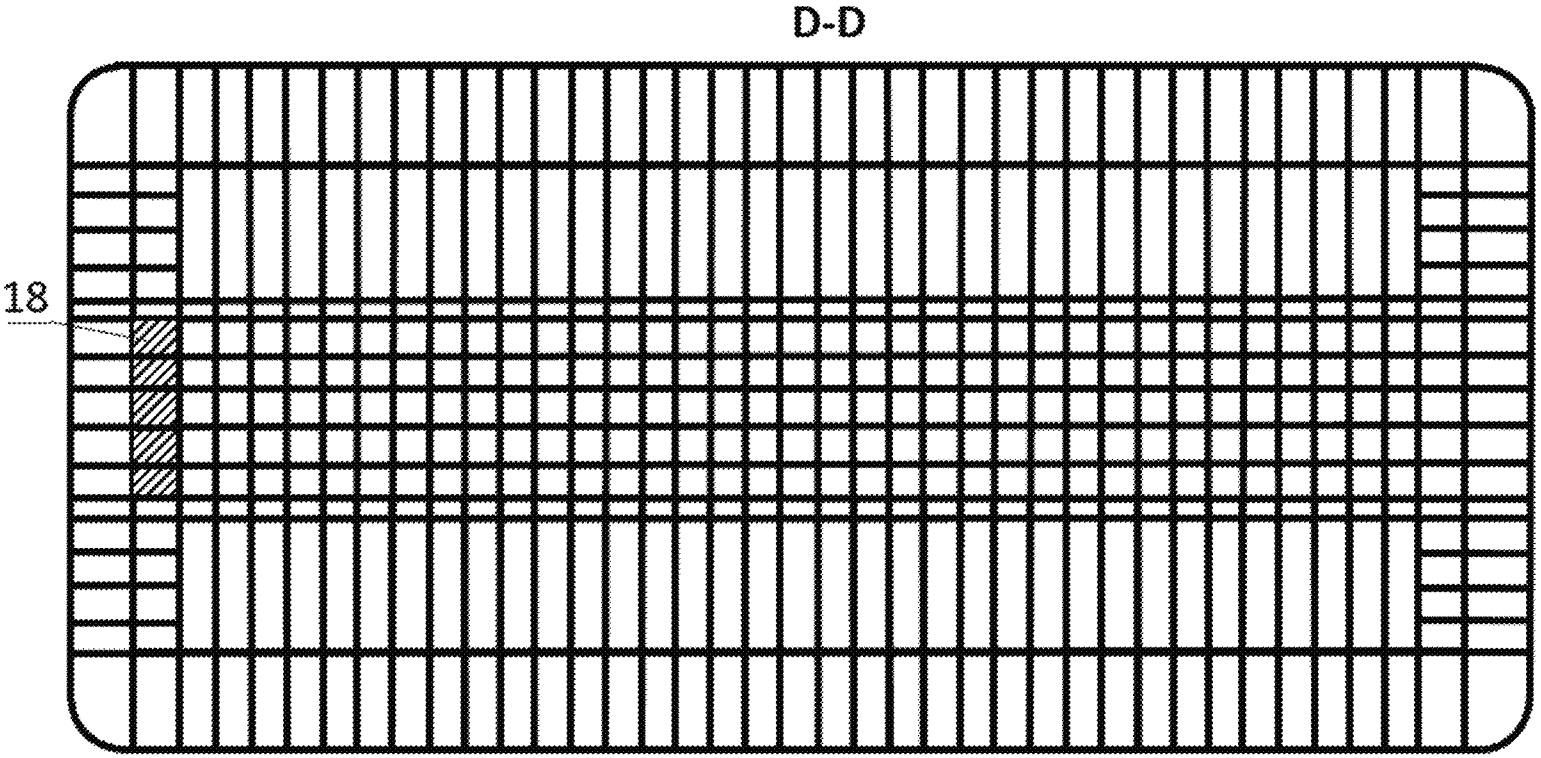

FIG. 6—the GBS vertical walls arrangement in section D-D for FIG. 2.

Figure 7:
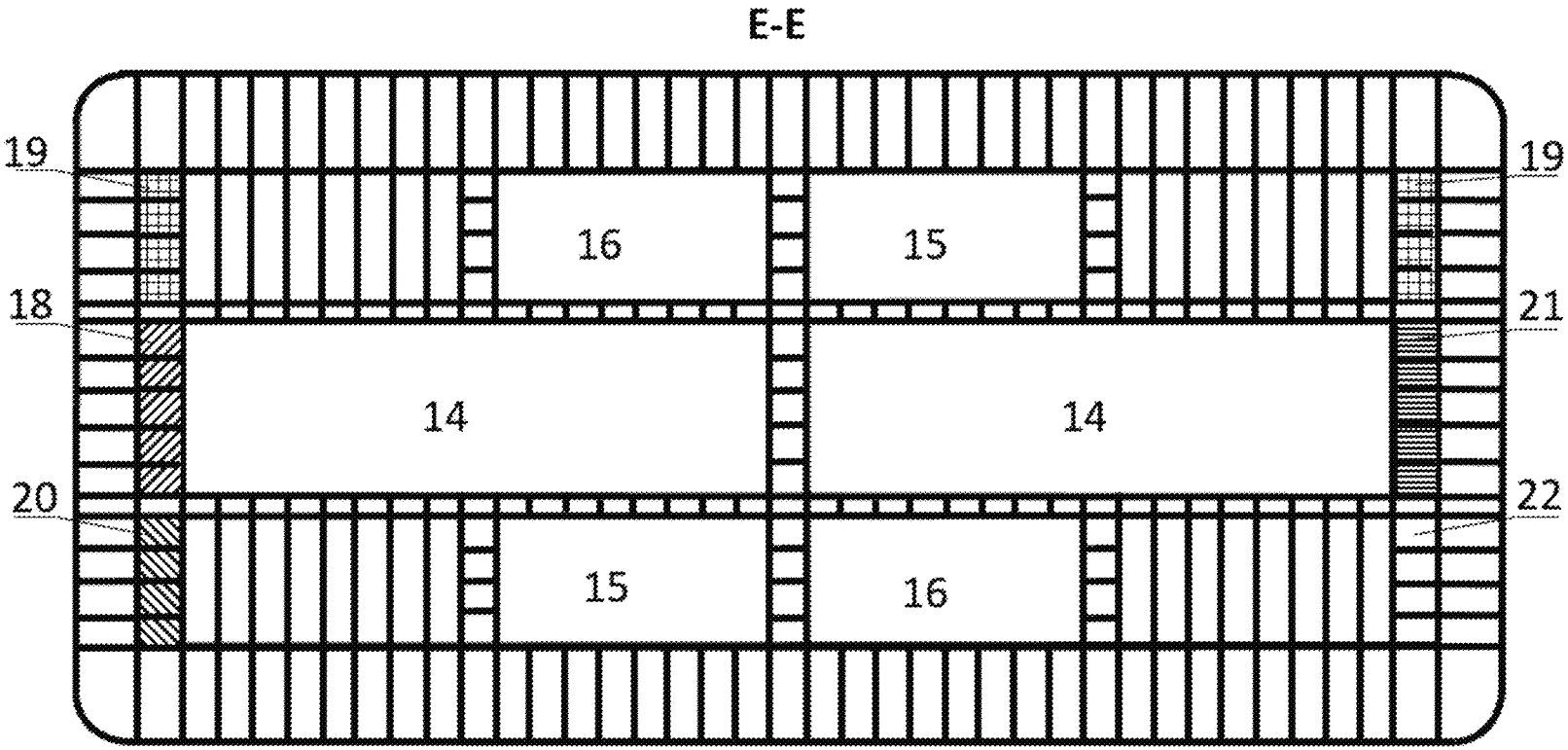

FIG. 7—GBS vertical walls' arrangement in section E-E for FIG. 2.

EXAMPLES OF IMPLEMENTATION OF THE INVENTION

The proposed GDCPSO offshore complex is a fully factory ready technical product that is a combination of process, engineering and auxiliary equipment for drilling, raw gas extraction, treatment, production, storage and offloading of LNG, WFLH and SGC.

GDCPSO is fabricated at a dedicated yard and towed afloat to the place of installation.

The GDCPSO is installed on dedicated underbase foundation 9 on seabed 27 (FIGS. 2 to 4) directly at the field, from which the feedstock is sourced, or at a distance from the field enabling hydrocarbon extraction operations, in accordance with the field development plan, where water depths exceed 14 m. To prevent scouring of GBS underbase foundation 9 and seabed 27 around the GBS, gabions or other similar structures or berm backfilling may be arranged for seabed reinforcement. Once the field development is completed, the production complex can be deballasted and moved to operate in a different location. It can therefore be used for hydrocarbon production from shallow and medium-depth fields.

GDCPSO development will make possible development of fields located in shallow areas of the Arctic seas.

The GDCPSO main components intended for hydrocarbon (raw gas) extraction, treatment and processing are the GBS and the topside—modularized drilling and process equipment (FIGS. 1 to 4).

The GBS is a three-dimensional reinforced-concrete structure serving as a support unit for the drilling facility, comprising drilling rig 10, flare unit 11, topside process modules 12 and living quarters module 13, and also functioning as a storage for respective products of processed raw gas, i. e. LNG, WFLH and SGC, consumables, chemicals, waste, and intended for installation on seabed 27 with the help of its own weight.

Central part 1 of the GBS is a rectangular prism with top slab 3. GBS protruding part 2 stretches along the sides of GBS central part 1 all around its perimeter. GBS central part 1 and protruding part 2 share base slab 4, with protruding part 2 being lower in height than central part 1.

GBS central part 1 includes main load-bearing structures—vertical walls 6 and horizontal slabs (top slab 3, base slab 4 and intermediate slab 5). The load-bearing structures support the required spatial rigidity of the GBS framework, for instance when the GDCPSO is transported and stays afloat prior to its installation. Vertical walls 6 made from reinforced concrete also separate the GBS into compartments in accordance with their intended use.

GBS top slab 3 accommodates reinforced-concrete supports 7, on which drilling rig 10, flare unit 11, process modules 12, and living quarters modules 13 are mounted.

Since vertical walls 6 also serve as load-bearing structures that transfer the load from the topside to the base slab 4 and underbase foundation 9, reinforced-concrete supports 7 are erected above the intersections of vertical walls 6 in GBS central part 1.

GBS top slab 3 slopes from the centerline towards the edges to evacuate atmospheric precipitation and process spills. Top slab 3 is designed to withstand explosion in case of emergencies. For cryogenic spill protection purposes, top slab 3 is reinforced with rebar made from very cold-resistant steel.

To distribute the load from the tanks that store LNG, one of the raw gas processing products, the design includes horizontal intermediate slab 5 between top slab 3 and base slab 4. Vertical walls 6 under this slab transfer the load to base slab 4 and ensure the spatial rigidity of the structure.

Reinforced concrete based on modified normal density concrete with tensioned reinforcement is the main material of GBS central part 1.

Vertical walls 6 separate GBS central part 1 into compartments (FIGS. 5 to 7). Some (compartments 14, 15, 16) are used to store finished products; some (compartments 17 along the long sides of the GBS) are used for water or solid ballast. Compartments 18 formed by the short-end walls of central part 1 on one side are used as borehole wells, at least one compartment 19 is used to store consumables, at least one compartment 20 is used to store chemicals, and at least one compartment 21 is used to store waste, and also at least one compartment 22 is used as an auxiliary compartment. GBS central part 1 also houses engineering compartments 23. During transportation and operation, compartments 19-23 are also used as ballast compartments. During operation, consumables, chemicals and waste in respective compartments 19, 20 and 21 are also considered as ballast.

Compartments 17 formed by vertical walls 6 of GBS protruding part 2 are included in the ballast system.

The GDCPSO can stay afloat during transportation by sea to the installation site and can withstand ice impact in ice conditions. To settle the floating GDCPSO into a fixed position on the underbase foundation 9 at the installation site, ballast compartments 17 are filled with sea water.

The GDCPSO external dimensions may vary depending on its production capacity.

The main space-planning solutions of the GBS structures are defined by technological parameters, as well as internal and external loads affecting the GBS structure, taking into account their maximum possible negative combination.

Protruding part 2 of the GBS serves the following main purposes:

- achieving the required target GBS buoyancy parameters;
- housing ballast compartments 17 primarily intended for the GBS balancing, ensuring the GBS being afloat with an even keel, without roll or trim;
- forming a natural protective barrier in case of design emergency collision/ship impact; protruding part 2 will withstand and absorb most of the collision energy, preventing damage to the main volume of the GBS framework ensuring the integrity and preservation of main tanks and load-bearing structures of the topside;
- housing auxiliary process and marine equipment ensuring tankers mooring and offloading of LNG, WFLH and SGC.

LNG, WFLH and SGC storage tanks are installed in GBS compartments 14, 15, 16.

GBS central part 1 has a number of tanks (FIG. 5) that may have different design depending on the properties of substances to be stored.

Membrane tanks are used for LNG storage. In this case, the tank consisting of a metal membrane made of stainless steel or invar (Fe—Ni alloy) separated from the concrete structure by a thermal insulation layer is installed inside the concrete compartment. The insulation layer is located directly on top slab 3, intermediate slab 5 and GBS vertical walls 6, transferring loads from the tank and its liquid content to the above-mentioned boundary structures. The GBS slabs and walls thus serve as support structures for membrane tanks, with which they are integrated into a single structural unit. To prevent any leaks, the bottom and the side surfaces of membrane tanks have a secondary barrier being an additional membrane installed inside the thermal insulation layer.

WFLH and SGC storage tanks are formed by GBS concrete compartments 15 and 16, with their boundary structures serving as a barrier.

Smaller storage compartments 19, 20 and 21 as consumables, chemicals, and waste tanks (e. g. diesel, oil, mud, service water, glycol solution, drill cuttings, drilling wastewater, demineralized water, fresh water, etc.) are located along the GBS short ends.

Auxiliary compartments 22 and engineering compartments 23 in GBS central part 1 are located on either side of main LNG, WFLH and SGC storage compartments 14, 15 and 16 and between them in the middle. These compartments are intended for process needs, equipment, service fluids, as well as access and evacuation routes for personnel. With dry compartments along the perimeter of main compartments for hydrocarbons storage, external surfaces of the boundary walls of compartments 14, 15 and 16 (LNG, WFLH and SGC storage tanks) can be inspected.

The engineering equipment includes: a power supply system, including substations; a heating, ventilation and air conditioning (HVAC) system; a ballast water heating and recirculation system; a water supply and disposal system; firewater pumps and pipelines; foam fire-fighting system skids; an electrochemical corrosion protection system; telecommunication and alarm systems and a video surveillance system. The engineering equipment, for the most part, is located on the top slab 3 and/or in/on process modules 12, with the remaining part being located in engineering compartments 23. Auxiliary compartments 22 can remain empty and accessible with the help of ladders and manholes.

Reinforced-concrete supports 7 for the topside modules on GBS top slab 3 ensure that the support load be transferred from drilling rig 10, flare unit 11, process modules 12, and living quarters module 13 to GBS main load-bearing structures. Structurally, supports 7 are reinforced-concrete pylons with heads for embedded components.

The locations of reinforced-concrete supports 7 correspond to intersections of GBS vertical walls 6 enabling the distribution of loads from the topside modules.

Reinforced-concrete supports 7 are designed to be high enough to provide enough space between GBS top slab 3 and a bottom of drilling rig 10, flare 11, process modules 12, and living quarters module 13 as may be necessary to install piping and cabling 24 between the topside and the equipment in the GBS compartments as well as to ensure access for people and vehicles across GBS top slab 3.

The GBS ballast system comprises inner ballast compartments 17, including those under intermediate slab 5, formed by vertical walls 6, as well as outer ballast compartments 17 in GBS central part 1 and GBS protruding part 2, respectively. To prevent the water in ballast compartments 17 from freezing, the design includes a ballast recirculation and heating system. The water in ballast compartments 17 is heated using waste heat from flue gas of gas turbines installed on the topside modules.

The ballast system performs two main functions:

- ballasting, i.e. changing the weight of GBS, ensuring required GBS draft when afloat and the structure stability once the GBS is installed on underbase foundation 9;
- GBS balancing, i.e. bringing GBS on an even keel, without roll and trim when afloat, through compensation with ballast water of deviation of the structure centre of gravity from its geometric center.

The topside comprises the process equipment composed of process modules 12. The number of process modules 12 is decided upon during the production complex engineering phase. Location of the modules on the GBS is assumed taking into account their weight to make sure the centre of gravity of the GDCPSO is close to the geometric center of the GBS so as to reduce the volume of water ballast required to balance out the structure when afloat.

Process modules 12 are three-dimensional steel frames with bracings, which accommodate process equipment, electrical equipment, automation systems, etc.

At a fundamental level, process modules 12 are not different from topside modules used in the oil and gas sector at marine oil and gas structures of other types in terms of their design and layout.

The modules accommodate process installations for purification and treatment of raw gas, equipment of gas liquefaction, equipment for offloading of LNG, WFLH and SGC to tankers, as well as auxiliary equipment and utilities.

The process systems for treatment and utilization of feedstock produced from wells are designed to work with formation fluid and produce gas, WFLH, and stable gas condensate. These systems are analogous to the systems usually used at onshore fields. The difference is that marine versions of the equipment are used.

For ease of equipment maintenance and personnel access, each process module 12 has several tiers (decks). Main tier 8 of each process module 12 is at the same height to enable combining routes for evacuation and load movement across the topside, thus reducing the load on GBS top slab 3. Other tiers of process modules 12 vary in height depending on their function and equipment.

The LNG, WFLH and SGC offloading jetties 25 are structurally integrated with the GBS and the topside, and are located along both long sides of the GBS. Jetties 25 are equipped with mooring fenders, breakers and offloading platforms with loading arms as well as other marine and process equipment enabling offloading. Drawings show water level 26 in the water area.

Compartments may be separated by transverse partitions, except for main LNG storage compartments 14. Openings may be made inside walls of ballast compartments 17 for water to flow through, and passages for personnel and penetrations for cabling and piping are made in engineering compartments 22 and 23.

The drilling facility is designed for operating conditions at offshore fields and have relevant climatic design. To ensure the works related to well drilling, the drilling facility comprise drilling rig 10 (FIG. 1, 4) with a handling device, blow-out preventing equipment, mud pumps, a mud circulating system, concreting facilities, pneumatic conveying system, a slurry preparation and injection system, a drilling wastewater collection system, hydraulic actuating gear for mechanisms of drilling rig 10, bulk materials depot, etc.

Drilling rig 10 of the GDCPSO ensures all-year-round multiple well drilling and workover of vertical, directional, and horizontal wells. Multiple well drilling is ensured by moving drilling rig 10 across the whole well pattern.

Drilling rig 10 is installed on a short end of GBS central part 1 with its underlying compartments 18 serving as borehole well.

Drilling rig 10 includes a base frame with a substructure with outfitted with equipment and systems ensuring well drilling. Drilling rig 10 handling devices allow to position it above any point in the well pattern and to fix drilling rig 10 in that position. The drilling is done through tborehole wells 18 in the GBS (FIG. 4-7).

Process systems for well fluid treatment and disposal are designed to operate as part of an integrated GDCPSO.

The design includes high-pressure and low-pressure flare systems for safe disposal of gases, including hydrocarbon gases/vapors, which are not consumed to produce power or heat, coming from high-pressure and low-pressure process equipment, respectively. The flare system is also engaged in emergencies and/or during blowdown. The gas coming from high-pressure and low-pressure systems is sent to flare unit 11 to be burned at the flare tip (FIG. 1, 3).

Living quarters module 13 is used to provide accommodation (FIG. 1, 3, 4). Living quarters module 13 is a safe, fully functional, fire-proof, reliably fixed building conforming to every applicable architectural, design, sanitary, and general technical requirement. Living quarters module 13 is developed as a part of the topside in conjunction with other structures and systems.

Living quarters module 13 is a fully functional modular structure containing living, public-use, sanitary, medical, and food premises as well as premises for auxiliary equipment to support the functionality of living quarters module 13.

In conformity with safety requirements, living quarters module 13 is installed as far away as possible from the most hazardous operating area, in which drilling facility 10 is located.

The invention claimed is:

1. An offshore production complex for raw gas extraction, treatment and processing comprising a substructure with a topside located on the substructure, the topside including a drilling facility, a flare unit, process equipment for raw gas treatment and processing, and living quarters, with the substructure accommodating storage tanks for respective processed products, wherein the substructure is a one-piece concrete gravity-based structure (GBS) that has a central part and a protruding part, with the central part being a rectangular prism with a top slab with the process equipment located on the top slab, and the GBS protruding part stretching along the central part sides all along a perimeter of the central part and having vertical external walls, the central part and the protruding part sharing a base slab, the protruding part being lower in height than the central part, the GBS central part having longitudinal and transverse walls that form compartments, including ballast compartments and compartments accommodating storage tanks for respective processed products, and the GBS protruding part having internal walls that are perpendicular to the external walls and form ballast compartments.

2. The complex according to claim 1, wherein the drilling facility includes a drilling rig installed on a short end of the GBS central part with underlying compartments of the central part serving as borehole wells.

3. The complex according to claim 1, wherein the GBS central part compartments formed by short-end walls of the central part on one side, include at least one consumables compartment, at least one chemicals compartment, and at least one waste compartment.

4. The complex according to claim 1, wherein some of the compartments in the GBS central part, including at least one of the compartments that is formed by short-end walls of the central part on one side, are auxiliary compartments.

5. The complex according to claim 1, wherein the GBS central part also has an intermediate horizontal slab with the storage tanks for respective processed products comprising liquefied natural gas located on the intermediate horizontal slab, and there are longitudinal and transverse walls forming additional ballast compartments between the intermediate horizontal slab and the base slab.

6. The complex according to claim 5, wherein some of the compartments in the GBS central part form storage tanks for other respective processed products comprising stable gas condensate and wide fraction of light hydrocarbons.

* * * * *